US005395682A

United States Patent [19]

Holland et al.

[11] Patent Number: 5,395,682

[45] Date of Patent: Mar. 7, 1995

[54] CARGO CURTAIN

[76] Inventors: John E. Holland, 423 Vance St., Bailey, N.C. 27807; Walten A. Fava, 500 Rolling Hills Pl., Apartment 903, Lancaster, Tex. 75146

[21] Appl. No.: 94,549

[22] Filed: Jul. 20, 1993

[51] Int. Cl.[6] ..... D03D 3/00

[52] U.S. Cl. ..... 428/225; 220/1.5; 428/219; 428/233; 428/246; 428/252; 428/284; 428/298; 428/340

[58] Field of Search ..... 428/225, 229, 233, 234, 428/246, 247, 252, 255, 298, 219, 300, 340, 284; 220/1.5

[56] References Cited

U.S. PATENT DOCUMENTS

| | | | |
|---|---|---|---|
| 4,413,110 | 11/1983 | Kavesh et al. | 526/348.1 |
| 4,538,663 | 9/1985 | Looker | 160/368 |
| 4,741,442 | 5/1988 | Slocumb | 428/255 |
| 4,909,156 | 3/1990 | Erickson | 105/359 |
| 4,944,974 | 7/1990 | Zachariades | 428/252 |
| 4,980,227 | 12/1990 | Sekiguchi et al. | 428/225 |
| 5,040,693 | 8/1991 | Podd et al. | 220/1.5 |
| 5,092,468 | 3/1992 | Slocumb | 428/255 |
| 5,104,714 | 4/1992 | Leiber et al. | 428/255 |
| 5,110,000 | 5/1992 | Nichols | 220/4.16 |

*Primary Examiner*—James J. Bell
*Attorney, Agent, or Firm*—Rhodes, Coats & Bennett

[57] ABSTRACT

Cargo curtains in the form of a woven fabric wherein the yarns of the fabric are primarily constructed of long chain expanded (ultra-high molecular weight) polyethylene fibers. The curtains thus formed have increased strength and durability characteristics, but are considerably lighter in weight than previously available.

11 Claims, 2 Drawing Sheets

CARGO CURTAIN

FIELD OF THE INVENTION

This invention is directed to flexible curtains for covering cargo containers, luggage trailers, and truck openings, and more particularly, to a fabric curtain cover that has minimal weight, but increased abrasion resistance, tear-strength, cut-and-stab resistance, and is compatible with the environment for which it is intended.

BACKGROUND OF THE INVENTION

Various types of material transporting vehicles and containers use fabric to cover one or more walls. While baggage trailers and trucks are such material transporting vehicles that use fabric on one or more walls, the invention will be discussed in the environment of a cargo container, but the same concepts apply to trucks and baggage trailers.

Cargo containers have been utilized for transporting air, land and sea cargo for many years. One kind of cargo container is a box-shaped container having a plurality of closed walls and one open end or wall. The open wall forms an access opening for loading cargo into and out of the cargo container. Various types of door closures can be used across the open end for opening and closing access to the cargo container.

Both rigid door closures and flexible fabric covers have been used as door closures for cargo containers. Fabric cargo covers are generally preferred over rigid door closures because they are lighter in weight and inexpensive as compared to rigid door closures. The prior art fabric covers, for example, a standard cargo cover for an airline cargo container, are typically constructed from canvas or from vinyl coated nylon or polyester. It is not believed that such fabric was designed and engineered for use in the environment in which cargo containers are used. Disadvantages of such vinyl-coated nylon or polyester fabric cargo covers are their lack of durability to withstand the stresses and conditions to which they are subjected during use and their weight.

The "durability" of a cargo cover is determined by its tear-strength, abrasion resistance, cut-and-stab resistance and ability to withstand cold and chemical exposure. These features of cargo cover durability have not been addressed in the cargo covers of the prior art made from vinyl-coated nylon or polyester. For example, standard airline cargo covers made from a vinyl-coated nylon having a weight of 18 oz. per square yard; a tear-strength of only approximately 250 lbs.; a dead tear-strength of as little as 50 lbs.; limited abrasion and abrasion resistance; and practically no cut-and-stab resistances. Because of the cover's lack of durability the fabric covers quickly become torn during use, resulting in the covers having a limited product life. The product life, for instance, of typical airline cargo cover is less than one year. When used in seagoing containers, because of the saltwater and atmosphere, this product life may be less.

The limited product life of a prior art fabric cargo cover is often the result of inadvertent or intentional ripping or tearing. For example, forklifts are often used to load and unload cargo containers onto rail cars, trucks and boats. The tines of the forklift often tear the fabric cargo covers when they are inadvertently maneuvered against the fabric cover during the loading process. The fabric cargo cover's lack of tear strength and cut resistance also makes the contents of the cargo container susceptible to theft. For instance, an employee or other individual can easily use a pocketknife to cut open presently available fabric covers to remove the cargo.

The problem of the lack of strength and cut resistance of prior art fabric cargo covers has been noted in one instance in the prior art. U.S. Pat. No. 4,538,663 to Looker discloses a new design for a cargo cover intended to address the lack of tear-strength of conventional fabric cargo covers. However, no change to the fabric material itself are disclosed. The Looker cargo cover includes a protective cable system extending across a conventional fabric. Adding cables to protect a fabric cargo even further increases the weight and expense.

In addition to durability and strength characteristics, the weight of a fabric cargo cover should be minimized to help limit the gross weight that is being transported. The vinyl-coated nylon or polyester, however, is a relatively heavy material. Any additional weight added to the gross cargo weight results in increased fuel consumption and costs to transport the cargo.

SUMMARY OF THE INVENTION

The present invention is directed to an improved fabric and fabric cargo cover fabricated from yarns formed of long chain expanded polyethylene fibers. One source of such fibers is sold by Allied Signal under the trademark "Spectra". These fibers are sometimes referred to as "ultra high molecular weight polyethylene" within the scope of U.S. Pat. No. 4,413,110. The specification and teachings of this patent are incorporated by reference. Such a fabric has a high level of tear-resistance, abrasion resistance, cut-and-stab resistance, and chemical and cold resistance to improve the strength and durability of the fabric. In addition, such fabric is about one-third the weight of such conventional fabrics as vinyl coated nylon. This results in fuel savings of about $30 per year for each pound of fabric used.

There are three separate embodiments of the improved fabric constructed from the above-described yarns. The first embodiment of the improved fabric is a fabric having a single layer with a preferred weight of approximately 6½ oz./square yard and preferably in the range of 5–8 oz./sq. yd. The single layer is formed from a plurality of warp and fill yarns of the type described woven together. The warp and fill yarns are of a weight in the range of 400–1,000 denier and the warp and fill counts are in the range of 28–36 yarns per inch. The range of parameters of the single layer fabric is designed to provide a fabric being extremely lightweight while also providing a sufficient strength and durability to withstand the use and environment to which a fabric cargo cover is exposed.

The second embodiment of the fabric includes a first woven layer and a second woven layer sewn together at intermittent points. In this embodiment, the range of parameters of the first and second layers are each substantially the same as those for the single layer of the first embodiment of the improved fabric. The double layer embodiment of the fabric increases the overall durability of the fabric but also doubles the weight of the fabric.

The third fabric embodiment of the present invention is a triple layer fabric having a outside layer, an inside layer, and an intermediate layer positioned between the outside and inside layers. The outside layer has warp and fill yarns of a weight in the range of 400–1,000 denier, and warp and fill counts in the range of 28–36 yarns per inch as described above. The innermost layer is also fabricated from yarns formed of long chain expanded polyethylene fibers. In this embodiment, however, these yarns are of a weight in the range of 200–500 denier, and woven with warp and fill counts in the range of 54–76 yarns per inch. The intermediate layer is a non-woven, needle punched fabric formed of the long chain expanded polyethylene fibers of a weight in the range of 400–900 denier. The three layer embodiment of the fabric has a weight per square inch in one preferred construction of 16½ oz./sq. yd. and preferably in the range of 12–23 oz./sq.yd.

The improved fabric is intended to be used as a fabric to cover cargo containers, luggage trailers, and truck openings. While the improved fabric can be used for a variety of purposes, the ensuing description is directed to a fabric cover for a cargo container.

Accordingly, it is an object of the present invention to provide a durable, lightweight fabric that has improved tear-strength, cut-and-stab resistance, abrasion resistance, cold resistance, and chemical resistance.

Another object of the present invention is to provide a fabric that can be used in the construction of a fabric cargo cover that increases the product life of the fabric cover.

DETAILED DESCRIPTION OF THE INVENTION

Figure 2:
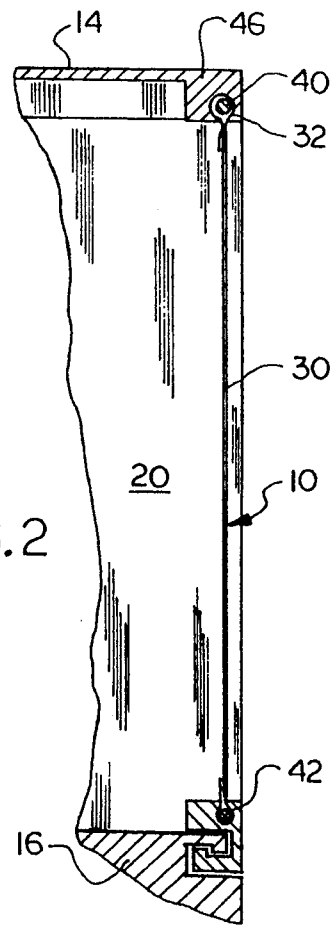
FIG. 2 and 2A is a cross-section taken substantially along lines 2—2 in FIG. 1 showing the latch assembly means for releasably connecting the fabric curtain cover frame to the cargo container.
Figure 3:
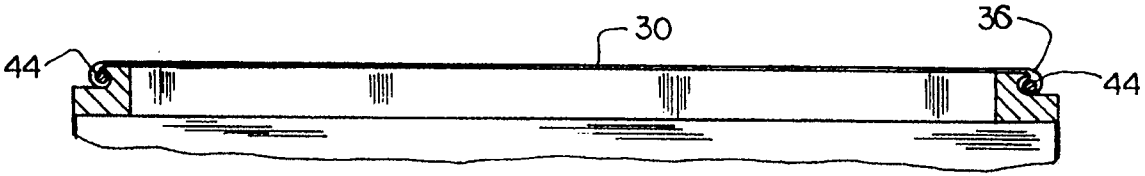
FIG. 3 is a cross-section taken along lines 3—3 in FIG. 1 showing the manner in which the sides of the fabric cargo cover are held in place.

Referring to the drawings, the fabric cargo cover of the present invention is indicated generally by the numeral 10. Cargo cover 10 of the present invention is used in conjunction with a cargo container 12 having a top wall 14, a bottom wall 16, side walls 20, and an open front. Cargo cover 10 is positioned across the open front of cargo container 12 for opening and closing access to the cargo container 12. Cargo container 12 is preferably designed with a bottom wall 16 having a pair of forklift openings 26 which allow the cargo container 12 to be readily moved by a forklift.

Figure 1:
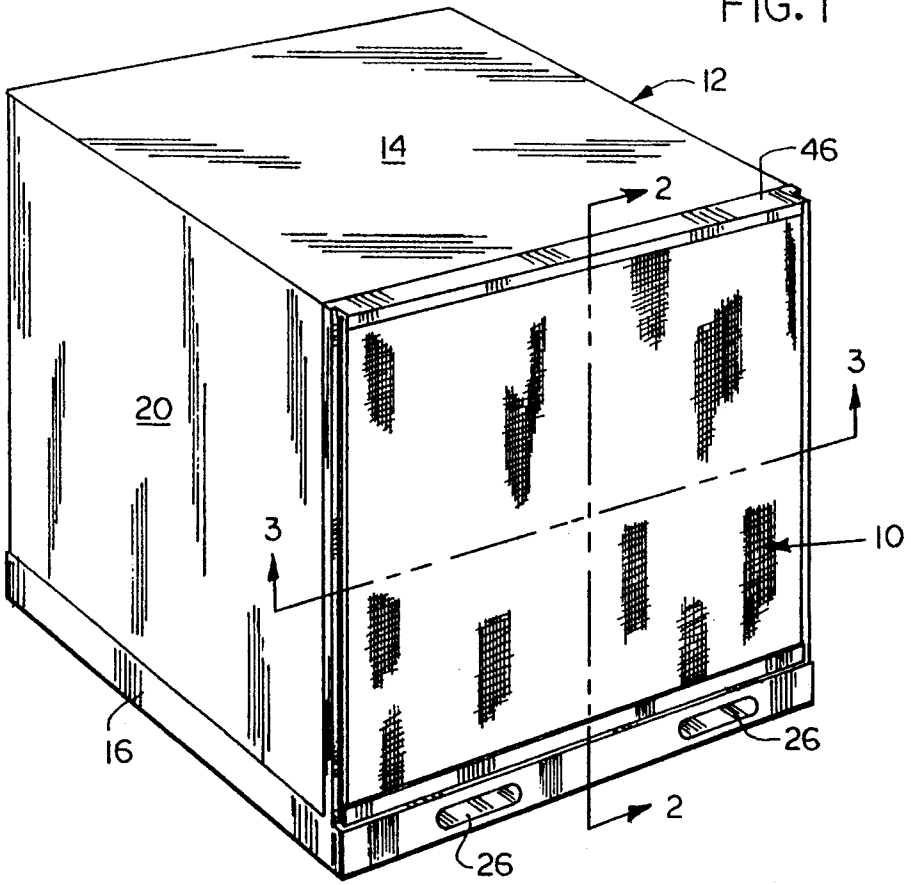
FIG. 1 is a perspective view of the cargo container fitted with a fabric cargo cover of the present invention.
Figure 6:
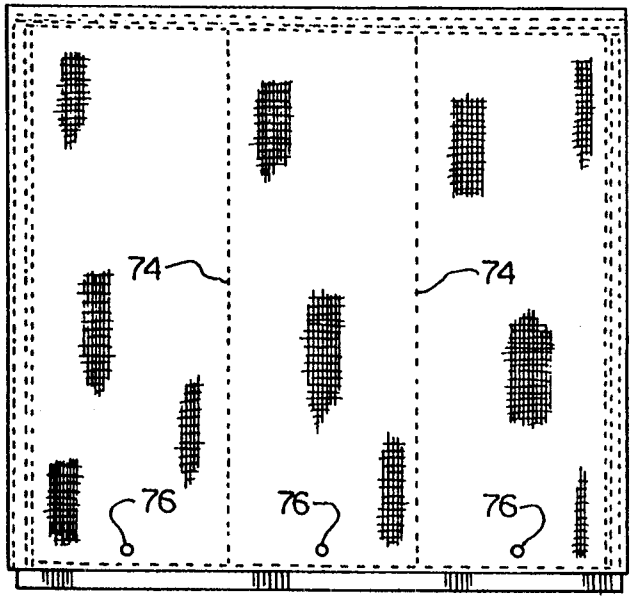
FIG. 6 is front view of the fabric cover constructed in accordance with the first or second alternative embodiment.

Cargo cover 10 includes a fabric 30 having a top hem 32, a bottom hem 34 and side hems 36. A plurality of cables extend through the hems 32,34,36 to provide support to fabric portion 30 of the cargo cover. In particular, a top cable 40 extends through top hem 32, a bottom cable 42 extends through bottom hem 34, and side cables 44 extend through side hems 36. Top wall 14 of cargo container 12 includes a front channel member 46 that extends along the front edge of top wall 14, as shown in FIG. 1. Top hem 32 and enclosed cable 40 are fitted into the channel member 46 to secure cargo cover 10 to the top wall 14 of cargo container 12.

Figure 2A:
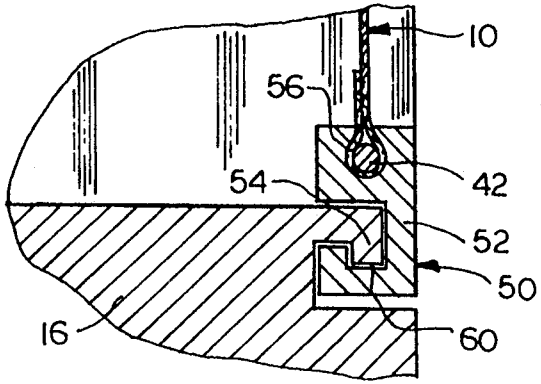

A latch assembly 50 (FIG. 2A) is used to releasably attach cover 10 to bottom wall 16 of cargo container 12. Latch assembly 50 includes a curtain latch member 52 which includes a channel 56 which, in turn, receives the edge of fabric 30 and a container latch member 54 fixed to bottom 16 of container 12. As shown in FIG. 2, curtain latch member 52 has a curtain channel 56 that secures bottom cable 42 and the encircling bottom hem 34 to the curtain latch member 52. Curtain latch member 52 also includes a notch 60 that allows curtain latch member 52 to be releasably mated with container latch member 54.

Fabric portion 30 of cargo cover 10 is preferably constructed from long chain expanded polyethylene fibers, as hereinabove described. The long chain expanded polyethylene fibers, when woven as described herein, have superior tear-strength, abrasion resistance, cut-and-stab resistance, chemical resistance and cold resistance. There are illustrated three different embodiments of cargo cover 10 which are designed to provide both a lightweight fabric cargo cover that is sufficiently durable to withstand conditions encountered during transporting cargo. The three embodiments of cargo cover 10 include, in addition to a single layer embodiment 30, a double layer embodiment 64 (FIG. 4), and a triple layer embodiment 66 (FIG. 5).

Single layer embodiment 30 of cargo cover 10 includes a fabric having a single layer formed from a plurality of warp yarns and fill yarns woven together. The yarns are of a weight in the range of 400–1,000 denier so woven that the warp and fill counts are in the range of 28–36 yarns per inch, resulting in a cargo cover 10 having a preferred weight of 6½ oz./square yard and in the range of 5–8 oz/sq. yd. Such a fabric exhibits a tear-strength of approximately 900 lbs. per inch, a dead tear-strength of 300 lbs., a high degree of abrasion resistance, a fair degree of cut-and-stab resistance, and a high degree of resistance to exposure to cold and chemicals.

Chemically, as compared to vinyl coated nylon, the long chain expanded polyethylene material is significantly more resistant to such commonly encountered chemicals as toluene, perchlorethylene, glacial acetic acid, ammonium hydroxide and hypophosphites; and greatly more resistant to hydrochloric acid, sodium hydroxide, and Chlorox ®.

Figure 4:
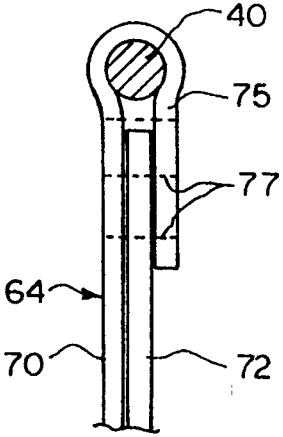
FIG. 4 is a sectional view of the top edge of a first alternative embodiment of the cover having two layers.
Figure 5:
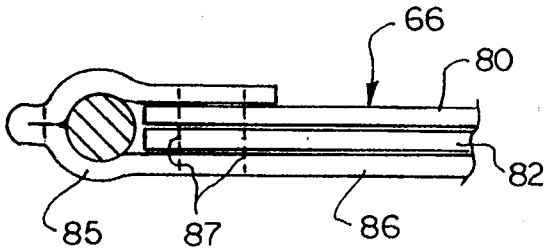
FIG. 5 is a sectional view of one side edge of a second alternative embodiment of the cover having three layers.

Referring to FIG. 4, a double layer embodiment 64 of cargo cover 10 is shown. Double layer embodiment 64 includes an outer layer 70 and an inner layer 72. Inner layer 72 confronts the space within cargo container 12. Both the outer layer 70 and inner layer 72 are constructed in a manner identical to single layer 62. As illustrated in FIG. 4, a top or bottom hem 75 is formed by folding over and doubling back an extended edge portion of outer layer 70 and applying multiple rows of stitches 77. The top rod 40 extends through the outer portion of hem 75 as illustrated. The bottom hem is formed in the same manner. Outer and inner layers 70,72 are connected together by spaced seams 74 that extend vertically along fabric 30 of cargo cover 10 at points spaced approximately 12 inches apart. The seams 84 extend vertically so that gravity will cause rain and other liquids coming into contact with a cargo cover 10 to be flushed through and out of the cargo cover 10 through eyelets 76. The double layer embodiment 64 of cargo cover 10 increases the durability of a cargo cover 10. For example, a double layer embodiment 64 having a weight of 13 oz. per square yard has been tested to have a tear-strength of approximately 900 lbs. per inch, a 500 lb. dead tear-strength, a high degree of abrasion resistance, a fair degree of cut-and-stab resistance, and a high degree of cold crack resistance.

Triple layer embodiment 66 of cargo cover 10 (FIG. 5) includes an outer layer 86, an inner layer 80, and an intermediate layer 82 formed between outer layer 76 and inner layer 80. Spaced seams extend vertically along the fabric portion 30 of cargo cover 10 at points spaced approximately 12 inches apart to attach outer, inner, and intermediate layers together.

Outer layer 76 is constructed in a manner identical to layer 30 of the single layer embodiment 62, as well as the inner and outer layers 70,72 of double layer embodiment 64. The warp yarns and fill yarns of inner layer 80 are of a weight in the range of 200–500 denier woven together with warp and fill counts in the range of 54–76 yarns per inch. Intermediate layer 82 is a needle-punch/non-woven layer where the fibers are of a weight in the range of 400–900 denier. As illustrated in FIG. 5, a side hem 85 is formed by folding over and doubling back an extended edge portion of outer layer 86 and applying multiple rows of stitches 87. The side rod 44 extends through the hem 85 between two adjacent rows of stitches 87 as illustrated. The other side hem is formed in the same manner. In FIG. 5, intermediate layer 82 is designed particularly to increase the cut and stab resistances of cargo cover 10. The needle-punch/non-woven construction of the intermediate layer 82 entangle a sharp point and make it difficult for a blade or other sharp object to pass therethrough. Accordingly, triple layer embodiment 66 of cargo cover 10 helps prevent cargo cover 10 from being substantially damaged from the impact of a forklift, and attempted cutting of the cargo cover 10 with a pocket-knife. The triple layer embodiment 66 of cover 10 has also been shown to have a high degree of overall durability. Tests have shown that a triple layer embodiment 66 of cover 10 with a weight of 16½ oz./sq. yd. has a tear-strength of 900 lbs./inch, a dead tear-strength of 700 lbs., maximum abrasion resistance, maximum cut and stab resistances, and maximum cold and chemical resistances. Again, seams 74 extend vertically to cause rain and other liquids to be flushed through and out of the cargo cover 10.

It should be recognized that the top and bottom rod arrangements of both the double and triple layer embodiments should be as illustrated in FIG. 4. Similarly, the side rod arrangements of both embodiments should be as illustrated in FIG. 5.

Testing has shown all three embodiments 62,64,66 of cargo cover 10 to be lightweight and durable. The cargo cover 10 of the present invention is more durable and lighter in weight than an analogous prior art cargo cover made from vinyl-coated nylon or polyester. For example, tests have shown that the durability of cargo cover 10 results in an expected product life of three or more years, as compared to a one-year or less expected product life for prior art cargo covers made from vinyl-coated nylon.

The present invention has been described as utilized on a cargo cover 10 for a cargo container 12. The fabric 30 used for cargo cover 10 may also be used for luggage trailer curtains and truck closure curtains generally covered by fabric and other uses where a lightweight, tear-resistant, abrasion resistant, stab-and-cut resistant, chemical resistant, and cold resistant fabric is required.

While several preferred embodiments are described in detail hereinabove, it is apparent that various changes might be made without departing from the scope of the invention which is set forth in the accompanying claims.

We claim:

1. A flexible fabric curtain for cargo containers and the like of the type comprising a plurality of side walls, a top wall, a bottom wall, and at least one open wall, said open wall being selectively covered by said fabric curtain, said fabric curtain comprising at least one layer of a woven fabric material including a plurality of warp yarns and fill yarns, said warp and fill yarns formed from long chain expanded polyethylene fibers, wherein the fabric curtain is sufficiently cut-resistant to prevent forklifts and pocketknives from penetrating the cargo container.

2. The fabric curtain of claim 1 wherein said warp yarns and fill yarns each have a weight in the range of 400–1,000 denier and are woven with warp and fill counts in the range of 28–36 yarns/inch.

3. The fabric curtain of claim 1 wherein said one layer has a weight in the range of 5–8 oz./sq. yd.

4. The fabric curtain of claim 1, and further including a second layer positioned adjacent said first layer, said yarns of each layer comprising long chain expanded polyethylene fibers.

5. The fabric curtain of claim 4 wherein said warp yarns and fill yarns of the second layer each have a weight in the range of 400–1,000 denier and the warp and fill counts are in the range of 28–36 yarns/inch.

6. The fabric curtain of claim 5 wherein the combined first and second layers have a weight per square inch in the range of 10–16 oz./sq. yd.

7. The fabric curtain of claim 4 further including an intermediate layer positioned between the first layer and the second layer, and wherein the intermediate layer is also constructed from long chain expanded polyethylene fibers.

8. The fabric curtain of claim 7 wherein the intermediate layer is a non-woven, needle punch construction.

9. The fabric curtain of claim 8 wherein the fibers of the intermediate layer are of a weight in the range of 400–900 denier.

10. The fabric curtain of claim 9 wherein said warp and fill yarns of said first layer are each of a weight in the range of 400–1000 denier and are woven with the warp and fill counts in the range of 28–36 yarns/inch; and said warp yarns and fill yarns of said second layer are of a weight in the range of 200–500 denier and the warp and fill counts are in the range of 54–76 yarns per square inch.

11. The fabric curtain of claim 8 wherein the combined three layers have a weight per square inch in the range of substantially 16½ oz./sq. yd.

* * * * *